US005403810A

United States Patent [19]

Sawamura et al.

[11] Patent Number: 5,403,810

[45] Date of Patent: Apr. 4, 1995

[54] REVERSIBLE THERMOSENSITIVE COLORING COMPOSITION AND REVERSIBLE THERMOSENSITIVE RECORDING MEDIUM USING THE SAME

[75] Inventors: Ichiro Sawamura, Numazu; Masaru Shimada, Shizuoka, both of Japan

[73] Assignee: Ricoh Company, Ltd., Tokyo, Japan

[21] Appl. No.: 154,560

[22] Filed: Nov. 19, 1993

[30] Foreign Application Priority Data

Nov. 20, 1992 [JP] Japan ..... 4-335425

[51] Int. Cl.[6] ..... B41M 5/30

[52] U.S. Cl. ..... 503/201; 106/21 R; 503/208; 503/209

[58] Field of Search ..... 106/21; 503/209, 201, 503/208; 427/150–152; 428/913

[56] References Cited

U.S. PATENT DOCUMENTS 4,061,836 12/1977 Yundt ..... 428/913

4,680,598 7/1987 Obitsu et al. ..... 427/151

*Primary Examiner*—Pamela R. Schwartz

*Attorney, Agent, or Firm*—Oblon, Spivak, McClelland, Maier & Neustadt

[57] ABSTRACT

A reversible thermosensitive coloring composition containing a coloring agent, a color developer and a guanidine derivative, the coloring composition capable of assuming a color development state when heated at a predetermined color development temperature at which the coloring composition is fused, and capable of assuming a decolorization state when heated at a predetermined temperature lower than the color development temperature. A reversible thermosensitive recording medium is also disclosed which is composed of a support and a thermosensitive recording layer formed thereon, containing the above-mentioned reversible thermosensitive coloring composition.

10 Claims, 1 Drawing Sheet

REVERSIBLE THERMOSENSITIVE COLORING COMPOSITION AND REVERSIBLE THERMOSENSITIVE RECORDING MEDIUM USING THE SAME

BACKGROUND OF THE INVENTION

1. Field of the Invention

The present invention relates to a reversible thermosensitive coloring composition comprising an electron donor compound and an electron acceptor compound, capable of inducing color formation by utilizing the coloring reaction between the electron donor compound and the electron acceptor compound. The present invention also relates to a reversible thermosensitive recording medium using the above-mentioned reversible thermosensitive coloring composition.

2. Discussion of Background

There is conventionally known a thermosensitive recording medium utilizing the coloring reaction between an electron donor compound (hereinafter referred to as a coloring agent) and an electron acceptor compound (hereinafter referred to as a color developer). This kind of thermosensitive recording medium is widely used in a variety of fields, such as in various recorders and printers for an electronic computer, a scientific measuring instrument, a facsimile apparatus, an automatic ticket vending apparatus, and a CRT medical measuring instrument. However, the coloring reaction of the conventional thermosensitive recording medium of this type has no reversibility, so that color development and decolorization cannot repeatedly be carried out.

A reversible thermosensitive recording medium capable of repeatedly recording images therein and erasing the images therefrom is proposed, which also utilizes the coloring reaction between the coloring agent and the color developer. For instance, a reversible thermosensitive recording medium comprising a mixture of gallic acid and phloroglucinol as the color developer is disclosed in Japanese Laid-Open Patent Application 60-193691. A colored material generated in this reversible thermosensitive recording medium by the application of heat thereto is removed therefrom with the application of water or water vapor thereto. However, this type of reversible thermosensitive recording medium has the shortcomings that it is difficult to impart a sufficient water resistance to the recording medium, the preservability of images recorded in the recording medium is poor, and an apparatus for removing the colored material cannot be made compact.

A rewritable optical recording medium comprising as the color developer phenolphthalein, thymolphthalein, or bisphenol is proposed as disclosed in Japanese Laid-Open Patent Application 61-237684. This type of optical recording medium produces a colored material by the steps of heating to a predetermined temperature (color development temperature) and gradually cooling, and the colored material thus generated in the recording medium is deleted therefrom when heated at a temperature higher than the color development temperature and then rapidly cooled. However, one of the drawbacks of this optical recording medium is that the coloring and decolorizing processes are complicated. In addition, the colored material is not removed from the recording medium completely through the decolorizing process, so that images with high contrast cannot be obtained.

As disclosed in Japanese Laid-Open Patent Applications 62-140881, 62-138568 and 62-138556, a reversible thermosensitive recording medium comprising a homogeneous mixture of a coloring agent, a color developer and a carboxylic acid ester is proposed. This reversible thermosensitive recording medium assumes a complete color development state at a predetermined temperature (a color development temperature), and a complete decolorization state at a predetermined temperature (a decoloriza-tion temperature) higher than the color development temperature, with each state being maintained at intermediate temperatures between the color development temperature and the decolorization temperature. Therefore, by the application of thermal energy to the recording medium using a thermal head, white images (decolorization state) can be formed on a colored background (color development state). Since the obtained images are negative as previously mentioned, the application of this type of reversible thermosensitive recording medium is restricted. In addition, it is necessary that the recorded images be maintained within a specific temperature region.

Furthermore, in reversible thermosensitive recording media disclosed in Japanese Laid-Open Patent Applications 2-188294 and 2-188293, a salt of gallic acid and higher aliphatic amine, and a salt of bis(hydroxyphenyl-)acetate or bis(hydroxyphenyl)butyrate and higher aliphatic amine are respectively employed as the color developers capable of reversibly achieving the color development action and the decolorization action. The color formation is induced at a predetermined color development temperature, and the colored material generated by the color formation process is removed from each recording medium when the recording medium is heated at a temperature higher than the color development temperature. However, the color development action and the color reduction action are competitively performed in each recording medium. Accordingly, it is difficult that both of the above-mentioned actions are thermally controlled to obtain a sufficient image contrast.

As previously mentioned, the conventional reversible thermosensitive recording media utilizing the reaction between the coloring agent and the color developer have various shortcomings, and they are unsatisfactory for use in practice.

The inventors of the present invention have proposed a reversible thermosensitive coloring composition comprising a leuco compound serving as a coloring agent and an organic phosphoric acid compound with a long-chain aliphatic group, a carboxylic compound with a long-chain aliphatic group, or a phenolic compound with a long-chain aliphatic group, as a color developer, and a reversible thermosensitive recording medium comprising a recording layer which comprises the above-mentioned coloring composition, as disclosed in Japanese Patent Application 3-355078. This coloring composition can readily achieve the color development and the decolorization merely by the application of heat thereto, and the color development state and the decolorization state can be maintained at room temperature. In addition to this, the decolorization temperature is lower than the color development temperature, and the formation of images and erasure thereof can be repeatedly carried out by changing the temperature of the coloring composition.

The above-mentioned reversible thermosensitive recording medium proposed by the inventors of the present invention are incomparably advantageous over the conventional ones. However, there is the problem that the hue of a colored image formed in the recording medium is changed by the application of light thereto. In other words, the preservability of the recording medium in the color development state is poor when the recording medium is placed with being exposed to light. In addition, the decolorization action does not proceed smoothly when the recording medium in the color development state is heated at a temperature lower than the color development temperature. As previously mentioned, the problems in the quality of the recording medium remain unsolved.

SUMMARY OF THE INVENTION

Accordingly, a first object of the present invention is to provide a reversible thermosensitive coloring composition utilizing the reaction between a coloring agent and a color developer, having such a sufficient light-resistance that the hue of the colored image is not changed and the colored image is completely erased by the decolorization process even when the coloring composition is exposed to the light.

A second object of the present invention is to provide a reversible thermosensitive recording medium comprising a recording layer which contains the above-mentioned reversible thermosensitive coloring composition.

The first object of the present invention can be achieved by a reversible thermosensitive coloring composition comprising a coloring agent, a color developer and a guanidine derivative, the coloring composition capable of assuming a color development state when heated at a predetermined color development temperature at which the coloring composition is fused, and capable of assuming a decolorization state when heated at a predetermined temperature lower than the color development temperature.

The second object of the present invention can be achieved by a reversible thermosensitive recording medium comprising a support and a recording layer formed thereon which comprises a reversible thermosensitive coloring composition comprising a coloring agent, a color developer and a guanidine derivative, the coloring composition capable of assuming a color development state when heated at a predetermined color development temperature at which the coloring composition is fused, and capable of assuming a decolorization state when heated at a predetermined temperature lower than the color development temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

A reversible thermosensitive coloring composition of the present invention (hereinafter referred to as a coloring composition) can induce color formation therein instantaneously when heated at a predetermined color development temperature, and the color development state can be maintained at room temperature in a stable condition. When the coloring composition in the color development state is heated at a predetermined temperature lower than the color development temperature, the coloring composition can assume a decolorization state and the decolorization state can also be maintained at room temperature in a stable condition.

The principle of the formation and erasion of images in a reversible thermosensitive recording medium according to the present invention which comprises a recording layer comprising the above-mentioned reversible thermosensitive coloring composition will now be explained with reference to the graph shown in FIG. 1.

Figure 1:
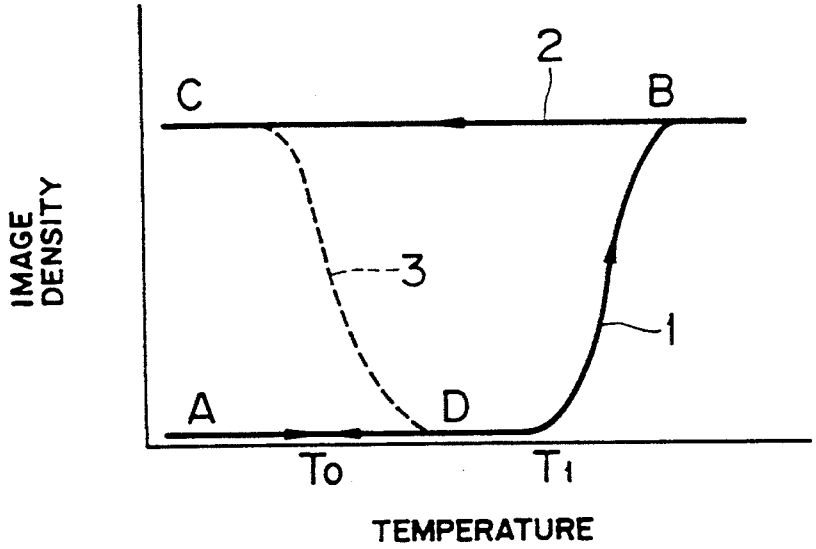
FIG. 1 is a graph which shows the relationship between the image density and the temperature of a reversible thermosensitive recording medium of the present invention, in explanation of the principle of the formation and erasion of images in the reversible thermosensitive recording medium.

In the graph shown in FIG. 1, the image density of a colored image is plotted as ordinate and the temperature as abscissa. A solid line 1 indicates the process of image formation in the reversible thermosensitive recording medium by the application of heat thereto; and a dashed line indicates the process of image erasure by the application of heat to the recording medium. The image density of a recording medium which is in a complete decolorization condition is indicated by an image density A; the image density of the recording medium in a saturated color development condition obtained by heating to a temperature $T_1$ or more is indicated by an image density B; the image density of the recording medium in the saturated color development condition at a temperature $T_0$ or less is indicated by an image density C; and the image density of the recording medium in a decolorization condition obtained by heating to a temperature between $T_0$ and $T_1$ is indicated by an image density D.

The reversible thermosensitive recording medium according to the present invention is in a decolorization condition with an image density A at a temperature $T_0$ or less. By heating the recording medium to a temperature $T_1$ or more using heat-application means such as a thermal head, the image density increases to the image density B, thereby forming a colored image in the recording medium. The image density B of the image thus recorded in the recording medium can be maintained as the image density C even though the temperature is decreased to $T_0$ or less along with the solid line 2. This means that the image once recorded in the recording medium has the memory characteristics. In the course of image formation, the image density increases with temperature from the point of temperature $T_1$, and the image density of the recording medium is saturated at the image density B.

To erase the colored image recorded in the recording medium, the recording medium in the color development state may be heated to a temperature between the. temperatures $T_0$ and $T_1$, which is lower than the color development temperature. Thus, the recording medium reaches a decolorization state with the image density D. Such a decolorization state of the recording medium can be maintained when the temperature is decreased to $T_0$ or less. In other words, the image density D in the decolorization state can be maintained as the image density A (same as the image density D at the temperature $T_0$ or less).

The process of the image formation in the recording medium proceeds through the solid line A-B-C and the recorded image is maintained with the image density C; and the process of the image erasure proceeds through the dashed line C-D-A, and the decolorization state of the recording medium can be maintained with the image density A. The behavior characteristics of such image formation and image erasure in the recording medium have a reversibility, so that the image formation and erasure can be repeated many times.

Figure 2A:
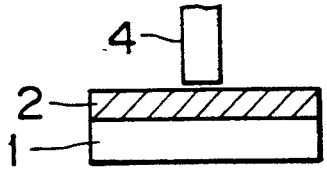
FIGS. 2A and 2B are schematic cross-sectional views which show one embodiment of the image formation process and the image erasure process using a reversible thermosensitive recording medium according to the present invention.
Figure 2B:
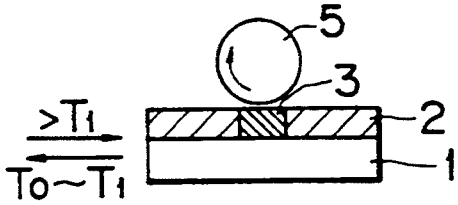

FIGS. 2A and 2B are schematic cross-sectional views which show one embodiment of the image formation process and the image erasure process using a reversible thermosensitive recording medium according to the present invention.

The reversible thermosensitive recording medium shown in FIGS. 2A and 2B comprises a support 1 and a recording layer 2 formed thereon, which comprises the previously mentioned reversible thermosensitive coloring composition. The image formation is carried out in FIG. 2A in such a manner that the recording medium is heated to a temperature $T_1$ or more as shown in FIG. 1 using a heat source for image formation such as a thermal head 4, so that a colored image 3 is obtained in the recording layer 2 of the recording medium as shown in FIG. 2B.

Further, to erase the colored image 3, the colored image 3 is heated to a temperature between $T_0$ and $T_1$ using a heat source for image erasure such as a heat-application roller 5. Thus, the colored image 3 is erased from the recording layer 2.

The reversible thermosensitive coloring composition of the present invention comprises a coloring agent, a color developer and a guanidine derivative. The color development occurs in the coloring composition of the present invention when the color developer and the coloring agent are fused and mixed under application of heat thereto to form a colored material. The colored material thus formed can be maintained when cooled to room temperature. When the colored material formed in the coloring composition is cooled to room temperature, rapid cooling is desirable because a temperature region where the colored material obtained in the coloring composition is erased therefrom (hereinafter referred to as a decolorization temperature region) is lower than the temperature where the coloring composition is fused to assume a color development state (hereinafter referred to as a color development temperature). If the coloring composition in a color development state is gradually cooled to room temperature, the colored material formed in the coloring composition is erased therefrom to some extent while the coloring composition passes through the decolorization temperature region, so that the image density of the colored material is decreased.

It is considered that the color development of the coloring composition of the present invention occurs when the ring opening of a lactone ring in the coloring agent takes place by the interaction between the molecules of the coloring agent and the color developer, thereby forming a colored material in the coloring composition. The coloring composition in the color development state comprises molecules of the colored material and molecules of the color developer and the coloring agent which are not directly concerned with the formation of the colored material. When the coloring composition is rapidly cooled to room temperature after assuming the color development state, the coloring composition is hardened by the cohesion among the aforementioned molecules, mainly by the cohesion between the molecules of the color developer which participate in the formation of the colored material and the superfluous molecules of the color developer not participating in the formation of the colored material. It is considered that the decolorization phenomenon occurs when such an aggregated structure of the coloring composition is changed.

The decolorization of the coloring composition is achieved by heating the coloring composition in the color development condition to a temperature in the specific decolorization temperature region. The aggregated structure of the coloring composition in the color development condition is changed during the decolorization process. It is observed by X-ray analysis that the molecules of the color developer finally crystallize out of the colored material and form crystals singly, thereby reaching the stable decolorization state.

It is obvious that an alkyl chain moiety of the color developer plays an important part in the color development process, that is, the formation of the colored material with an aggregated structure, and the decolorization process of the colored material, that is, the erasion of the colored material.

In preparing the coloring composition according to the present invention, the coloring agent and the color developer may appropriately be selected with the tone of the obtained colored material and the decolorization characteristics, that is, the promptness of the decolorization phenomenon being taken into consideration. The decolorization characteristics of the coloring composition can be examined by the differential thermal analysis (DTA) and the differential scanning calorimetry (DSC) of the coloring composition in the color development condition. Specifically, the preferable combination of the color developer and the coloring agent with good decolorization characteristics can be judged from an exothermic peak in the heat-up process in the DTA and DSC, which is characteristic of the decolorization characteristics of the coloring composition of the present invention.

The guanidine derivative for use in the coloring composition relates to the improvement of light resistance of the coloring composition, and does not directly participate in the formation of the color development state and the decolorization state of the coloring composition. The reversible color development and decolorization behavior is not influenced by the guanidine derivative and other additive components than the coloring agent and the color developer. Similarly, the thermosensitive recording layer of the reversible thermosensitive recording medium may further comprise an additional material such as a polymeric compound. Even though such a material is added to the recording layer, the reversible color development and decolorization behavior of the recording layer is not impaired.

The color developer for use in the coloring composition according to the present invention is in principle a compound having within its molecule a structure which is capable of inducing color formation in the coloring agent, and a structure with an alkyl chain having 5 or more carbon atoms, capable of controlling the intermolecular cohesion. For instance, an organic phosphoric acid compound, an aliphatic carboxylic acid compound and a phenolic compound, which have an aliphatic group having 12 or more carbon atoms; a metallic salt of mercaptoacetic acid having an aliphatic group with 10 to 18 carbon atoms; and an alkyl ester of caffeic acid having an alkyl group with 5 to 8 carbon atoms can be used as the color developers. The aliphatic group for use in the above-mentioned compounds includes a straight-chain or branched alkyl group or alkenyl group, which may have a substituent such as a halogen atom, an alkoxyl group or an ester group.

Of the above compounds, long-chain alkylphosphonic acid, long-chain α-hydroxyaliphatic acid, long-chain alkylthiomalic acid, long-chain alkylmalonic acid are particularly preferred as the color developers in the present invention.

The coloring agent for use in the coloring composition of the present invention is a colorless or light-colored electron donor type dye precursor. For example, triphenylmethanephthalide compounds, fluoran compounds, phenothiazine compounds, leuco-auramine compounds and indolinophthalide compounds are preferably employed as the coloring agents.

Specific examples of the color developer and the coloring agent for use in the coloring composition of the present invention are described in detail in Japanese Patent Applications 3-355078, 4-191643 and 4-207604. The guanidine derivative which is contained in the reversible thermosensitive coloring composition of the present invention to improve the light resistance is represented by formula (I) or (II):

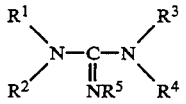
(I)

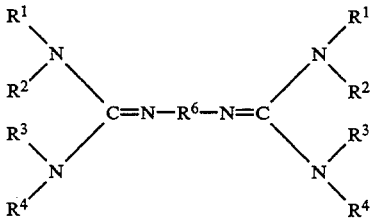
(II)

wherein $R^1$, $R^2$, $R^3$, $R^4$, and $R^5$ in formulas (I) and (II) each is hydrogen, an alkyl group, a cyclic alkyl group, an acyl group, an acylamino group, or an aryl group which may have a substituent such as a lower alkyl group, an alkoxyl group, nitro group, amino group, an alkylamino group, an acylamino group or a halogen atom; and $R^6$ in formula (II) is a lower alkylene group, phenylene group, naphthylene group, or a bivalent substituent of formula (III):

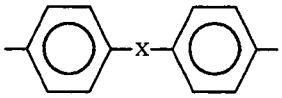
(III)

in which X is a lower alkylene group, $—SO_2—$, —S—S—, —S—, —O—, —NH— or a single bond connecting the two phenyl groups.

Specific examples of the guanidine derivative for use in the present invention are as follows:

1,3-dicyclohexylguanidine,
1-benzyl-3-phenylguanidine,
1-phenyl-3-p-tolylguanidine,
1,3-diphenyl-2-p-tolylguanidine,
1,3-diphenyl-2-cyclohexylguanidine,
1,3-dicyclohexyl-2-phenylguanidine,
1,2,3-tricyclohexylguanidine,
1,3-di-p-methoxyphenylguanidine,
1,3-di-p-methoxyphenyl-2-cyclohexylguanidine,
1,3-dicyclohexyl-2-o-tolylguanidine,
1,3-dicyclohexyl-2-(2,4-dimethylphenyl)guanidine,
1,3-dicyclohexyl-2-p-tolylguanidine,
1,3-dicyclohexyl-2-(2,5-dichlorophenyl)guanidine,
1,1-dicyclohexyl-2,3-diphenylguanidine,
1,1-dimethyl-3-phenylguanidine,
1,3-diphenylguanidine,
1,3-di-o-tolylguanidine,
1-hexyl-3-phenylguanidine,
1-octadecyl-3-phenylguanidine,
1-benzoyl-3-phenylguanidine,
1,2,3-triphenylguanidine,
1,1,3-triphenylguanidine,
1,2-dibenzoyl-3-phenylguanidine,
1-(o-tolyl)biguanide,
p-di(1,3-diphenylguanidino)diphenyl,
1,2-di-(1-phenylguanidino)ethane, and
di-(1,2,3-triphenylguanidino)methane.

These guanidine derivatives may be used alone or in combination to improve the light resistance of the coloring composition.

It is preferable that the weight ratio of the guanidine derivative to the coloring agent be in the range from (0.5:100) to (100:100), more preferably in the range from (5:100) to (50:100) in the coloring composition. When the amount of the guanidine derivative contained in the coloring composition is within the above-mentioned range, the effect of improving the light resistance is sufficient, and the image density of the colored image is not lowered and the preservability of the colored images is not decreased.

In the reversible thermosensitive coloring composition according to the present invention, it is preferable that the molar ratio of the color developer to the coloring agent be in the range from (1:1) to (20:1), more preferably in the range from (2:1) to (10:1) to obtain sufficiently high image density of the colored image. The previously mentioned color developers may be used alone or in combination or the coloring agents may also be used alone or in combination as long as the above-mentioned molar ratio of the color developer to the coloring agent is satisfied.

Even though the aforementioned ratio of the color developer to the coloring agent is satisfied, the decolorization characteristics delicately vary depending upon the ratio of the coloring agent to the color developer. When the amount of the color developer is relatively large, the decolorization initiation temperature is lowered. On the other hand, when the amount of the color developer is relatively small, the decolorization sharply occurs with respect to the temperature. Therefore, the amount ratio of the color developer to the coloring agent may be determined in accordance with the application of the coloring composition.

The reversible thermosensitive coloring composition according to the present invention may further comprise a variety of additives to improve the preservability of the colored images and the decolorization characteristics.

For example, when an antioxidant is used with the guanidine derivative in the reversible thermosensitive coloring composition, the light resistance of the coloring composition can be further improved. An agent which can prevent the initiation of oxidation chain reaction (hereinafter referred to as the oxidation initiation preventing agent), such as an ultraviolet absorber or a light stabilizer is preferable as the antioxidant in the present invention. In addition to this, a peroxide decomposing type antioxidant capable of easily decomposing a peroxide generated in the oxidation and converting the peroxide into a stable compound is effective as the antioxidant. The effect of improving the light resistance of the reversible thermosensitive recording medium is striking when the guanidine derivative is used with the oxidation initiation preventing agent such as the ultraviolet absorber or light stabilizer, and more striking when the guanidine derivative, the oxidation initiation preventing agent, and the peroxide decomposer are used in combination. This fact suggests that the photo-deterioration of the reversible thermosensitive recording medium is caused by photo-oxidation. The guanidine derivative serves to trap a generated radical therein to prevent the chain reaction, so that the guanidine derivative is regarded as effective in the prevention of photo-oxidation. When the guanidine derivative and the above-mentioned antioxidants are used in combination, it is considered that their synergistic effect is brought on each stage of the chain reaction, thereby efficiently preventing the chain reaction of oxidation.

In the present invention, a salicylic acid based ultraviolet absorber, a benzophenone based ultraviolet absorber and a benzotriazole based ultraviolet absorber are preferably employed as the ultraviolet absorbers. Specific examples of such ultraviolet absorbers used with the guanidine derivative in the coloring composition according to the present invention are as follows: phenyl salicylate, monoglycol salicylate, p-t-butylphenyl salicylate, 2-hydroxy-4-methoxybenzophenone, 2-hydroxy-4-octoxybenzophenone, 2(2-hydroxy-5-methylphenyl)benzotriazole, 2(2-hydroxy-3,5-di-t-butylphenyl)benzotriazole, 2(2-hydroxy-3-t-butyl-5-methylphenyl)benzotriazole, resorcinol monobenzoate, and 2'-ethylhexyl-2-cyano-3-phenylcinnamate.

As the light stabilizer used with the guanidine derivative in the coloring composition, hindered amine, such as bis(2,2,6,6-tetramethyl-4-piperidine)sebacate, is preferably employed.

It is preferable that the ratio by weight of the above-mentioned oxidation initiation preventing agent such as the ultraviolet absorber or light stabilizer to the coloring agent be in the range from (0.5:100) to (100:100), more preferably in the range from (1:100) to (50:100) in the coloring composition. When this kind of antioxidant is contained in the coloring composition within the aforementioned range, sufficient anti-oxidant action can be obtained, with the decrease of the image density of the colored image and the decrease of the image preservability being prevented.

In addition, a sulfur based antioxidant and a phosphorus based antioxidant are preferably used as the peroxide decomposing type antioxidants.

Specific examples of the sulfur based antioxidant include dilauryl thiodipropionate, distearyl thiodipropionate, laurylstearyl thiodipropionate, dimyristyl thiodipropionate, distearyl $\beta,\beta'$-thiodibutyrate, 2-mercaptobenzimidazole, and dilauryl sulfite.

Specific examples of the phosphorus based antioxidant include triphenyl phosphite, trioctadecyl phosphite, tridecyl phosphite, trilauryl trithiophosphite, and 9,10-dihydro-9-oxa-10-phosphaphenanthrene-10-oxide.

It is preferable that the ratio by weight of the above-mentioned peroxide decomposing type antioxidant to the coloring agent be in the range from (0.5:100) to (100:100), more preferably in the range from (5:100) to (50:100) in the coloring composition. When the peroxide decomposer is contained in the coloring composition within the aforementioned range, sufficient anti-oxidant action can be obtained, with the decrease of the image density of the colored image and the decrease of the image preservability being prevented.

When the oxidation initiation preventing agent such as the ultraviolet absorber or light stabilizer, and the peroxide decomposing type antioxidant are used in combination, it is desirable that the weight ratio of all the antioxidants to the coloring agent be in the range from (0.5:100) to (100:100), more preferably in the range from (5:100) to (50:100).

The ratio of the amount of the guanidine derivative to the amount of the antioxidant varies depending on the kinds of coloring agent, color developer and antioxidant to be employed in the coloring composition. In general, it is preferable that the weight of the guanidine derivative be 0.5 to 10 times, more preferably 1 to 5 times that of the antioxidant. Further, it is preferable that the weight ratio of the mixture of the guanidine derivative and the antioxidant to the coloring agent be in the range from (0.5:100) to (100:100), more preferably in the range from (5:100) to (50:100) in the coloring composition.

When the oxidation initiation preventing agent such as the ultraviolet absorber or light stabilizer, and the peroxide decomposer are contained in the reversible thermosensitive coloring composition of the present invention, it is preferable that the respective ratios by weight of the coloring agent, the color developer, the guanidine derivative, the oxidation initiation preventing agent and the peroxide decomposer be 1:(1 to 20):(0.5 to 50):(0.5 to 50):(0.5 to 50).

The reversible thermosensitive recording medium according to the present invention comprises a support and a thermosensitive recording layer formed thereon, comprising the above-mentioned reversible thermosensitive coloring composition. Any material that can support the recording layer thereon, for example, a sheet of paper or synthetic paper, a plastic film, a composite material thereof, or a glass plate is used as the support for use in the recording medium of the present invention.

The thermosensitive recording layer of the recording medium may be formed by fusing a mixture of the color developer, the coloring agent and the guanidine derivative, and cooling the fused mixture. Generally, to increase the life of the recording medium, the color developer, the coloring agent, the guanidine derivative and other additives such as the light resistance improving agents are thoroughly dispersed in a binder resin to prepare a coating liquid for the recording layer. In this case, the coloring agent, the color developer,.the guanidine derivative and other additives such as the light resistance improving agents may uniformly be dispersed or dissolved in water or an organic solvent with the addition of the binder resin thereto to prepare the recording layer coating liquid, and the coating liquid thus prepared may be coated on the support and dried by a conventional method.

Furthermore, when necessary, various kinds of additives which are employed in a conventional thermosensitive recording sheet, such as a dispersant, a surface active agent, a poly-cation-based electroconductivity imparting agent, a filler, a colored image stabilizer, an antioxidant, a light stabilizer, and a lubricant may be contained in the recording layer to improve the coating properties of the recording layer coating liquid, and to upgrade the recording characteristics of the obtained recording layer.

Any conventional binder resins are usable for the recording layer. Specific examples of the binder resin include hydroxyethyl cellulose, hydroxypropyl cellulose, methoxy cellulose, carboxymethyl cellulose, methyl cellulose, cellulose acetate, gelatin, casein, starch, sodium polyacrylate, polyvinyl pyrrolidone, polyacrylamide, polyvinyl chloride, polyvinyl acetate, vinyl chloride - vinyl acetate copolymer., polystyrene, styrene based copolymer, phenoxy resin, polyester, aromatic polyester, polyurethane, polycarbonate, polyacrylic acid ester, polymethacrylic acid ester, acrylic acid based copolymer, maleic acid based copolymer, polyvinyl alcohol, chlorinated vinyl chloride resin, and a mixture of the above-mentioned resins.

The binder resin for use in the recording layer serves to prevent the aggregation of the reversible thermosensitive coloring composition by the repeated operations of color development and decolorization, and to retain the coloring composition in such a fashion that the coloring composition is uniformly dispersed in the recording layer. In particular, since the coloring composition is apt to aggregate by the application of heat thereto in the color development process, the binder resin for use in the recording layer with high heat resistance is preferably used. It is considered that various characteristics of the binder resin for use in the recording layer have a serious effect on the behavior of the reversible thermosensitive coloring composition.

The recording medium according to the present invention may further comprise a protective layer which is provided on the recording layer to improve the durability of the recording medium. The protective layer serves to prevent the deformation or color change of the surface of the recording medium by the application of heat and pressure thereto, and improve the chemical resistance, the water resistance, the abrasion resistance and the head-matching properties of the recording medium. In view of the above-mentioned functions of the protective layer, materials with excellent heat resistance and high mechanical strength are preferably employed for the protective layer. For instance, a silicone rubber and a silicone resin as disclosed in Japanese Laid-Open Patent Application 63-221087; a polysiloxane graft polymer as in Japanese Laid-Open Patent Application 63-317385; and a thermosetting resin, an ultraviolet-curing resin and an electron radiation curing resin are used for the protective layer. In addition, a water-soluble polymer or a water-based emulsion of a hydrophobic polymeric compound may also be used for the protective layer.

By the provision of the protective layer, not only the heat resistance is improved, but also the resistances to an organic solvent, a plasticizer, oil, sweat, and water are increased, so that the image formation and erasure can be repeated with no difficulty even under unfavorable circumstances.

The protective layer may further comprise a light stabilizer, a poly-cation-based electroconductivity imparting agent, an organic or inorganic filler, and a lubricant. The light resistance of the colored image formed on the recording medium, and the light resistance of the background of the recording medium can be improved by the addition of the light stabilizer; the antistatic effect can be obtained by the poly-cation-based electroconductivity imparting agent; and the sticking of the recording medium to the thermal head can be prevented, and the reliability and head-matching properties are improved by the addition of the filler and the lubricant.

To form the protective layer, the above-mentioned components are uniformly dispersed or dissolved in water or an organic solvent to prepare a coating liquid for the protective layer, and the coating liquid thus prepared is uniformly coated on the recording layer and dried. The thickness of the protective layer is preferably in the range from about 0.5 to 10 μm.

The reversible thermosensitive recording medium of the present invention may further comprise an undercoat layer which is provided between the support and the thermosensitive recording layer.

The undercoat layer serves to improve the heat insulating properties, the adhesive properties between the support and the recording layer, and the resistance of the support to the solvent used in the formation of the recording layer. The provision of the undercoat layer may be determined with the kind of material for the support taken into consideration.

The heat insulating properties are improved by the provision of the undercoat layer, so that the thermal energy applied to the recording medium can efficiently be used for the image formation and image erasure. Namely, the color development and the decolorization can be performed sharply owing to the provision of the undercoat layer. In the case where the undercoat layer is provided with a stress being laid upon the improvement of the heat insulating properties, the undercoat layer comprising minute void organic or inorganic particles may be provided on the support. More specifically, minute void particles with a particle diameter of about 10 to 50 μm made of glass, ceramics or plastics may thoroughly be dispersed in a solvent with a binder resin, and such a coating liquid for the undercoat layer may be coated uniformly on the support and dried. In the preparation of the undercoat layer coating liquid, the same binder resins as those used in the recording layer coating liquid can be employed.

Instead of the provision of the above-mentioned undercoat layer with the heat insulating properties, a support with heat insulating properties, such as a sheet of synthetic paper or a plastic film may be employed to make good use of the thermal energy applied to the recording medium.

To form the colored images in the reversible thermosensitive recording medium of the present invention, a heat pen, a thermal head, or laser can be used depending on the application of the recording medium. The colored images obtained in the recording medium can be erased therefrom using any heat-application means capable of heating the recording medium to a predetermined decolorization temperature, such as a heat-application roller, a heat-application plate, a thermostatic chamber, warm air, or a thermal head. In addition, the image formation can be carried out using a thermal head of which temperature is set to a predetermined color development temperature of the color composition while the recorded images are erased from the recording medium using the other thermal head of which temperature is set to a predetermined decolorization temperature of the color composition.

Other features of this invention will become apparent in the course of the following description of exemplary embodiments which are given for illustration of the invention and are not intended to be limiting thereof.

EXAMPLE 1

The following components were placed in a desk-top ball mill together with stainless steel balls:

| | Parts by Weight |
|---|---|
| 2(o-chloroanilino)-6-dibutylamino-fluoran | 2 |
| Octadecyl phosphonic acid | 6.7 |
| Vinyl chloride - vinyl acetate copolymer (Trademark "VYHH" made by Union Carbide Japan K.K.) | 10 |
| Methyl ethyl ketone | 45 |
| Toluene | 45 |
| 1,3-dicyclohexyl-2-(2,5-dichlorophenyl)guanidine | 0.2 |

The mixture of the above-mentioned components was dispersed in the ball mill for 48 hours, so that the average particle diameter of octadecyl phosphonic acid reached about 1 to 3 μm. Thus, a coating liquid for a thermosensitive recording layer was prepared.

The thus prepared recording layer coating liquid was coated on a polyethylene terephthalate film with a thickness of 100 μm serving as a support by a wire bar and dried, so that a reversible thermosensitive recording layer with a thickness of about 5.0 μm was provided on the support.

Thus, a reversible thermosensitive recording medium No. 1 according to the present invention was obtained.

The reversible thermosensitive recording medium No. 1 was brought into contact with the surface of a hot plate of 120° C. for about 20 seconds, so that the recording medium No. 1 assumed a color development state. The image density of the recording medium No. 1 in the color development state was measured by Mcbeth densitometer RD-914. Then, the recording medium No. 1 was placed in a thermostat of 70° C. for 10 minutes, so that the recording medium No. 1 assumed a decolorization state. The image density of the recording medium No. 1 in the decolorization state was again measured by Mcbeth densitometer RD-914.

The results of this image formation and erasure test are shown in Table 1.

Furthermore, the recording medium No. 1 in the color development state was exposed to fluorescent lighting of 4 klux for 24 hours, and the image density of the recording medium No. 1 was measured by Mcbeth densitometer RD-914. Thereafter, the state of the recording medium No. 1 was changed from the color development state to the decolorization state by the same manner as previously mentioned. Then, the image density of the recording medium No. 1 in the decolorization state was similarly measured by Mcbeth densitometer RD-914.

The results of this light-resistance test are also shown in Table 1.

EXAMPLES 2 TO 5 AND COMPARATIVE EXAMPLE 1

The procedure for the preparation of the reversible thermosensitive recording medium No. 1 according to the present invention in Example 1 was repeated except that 1,3-dicyclohexyl-2-(2,5-dichlorophenyl)guanidine used in the recording layer coating liquid in Example 1 was replaced by the respective guanidine derivatives shown in Table 1.

Thus, reversible thermosensitive recording media Nos. 2 to 5 according to the present invention and a comparative reversible thermosensitive recording medium No. 1 were obtained.

Using each of the above prepared recording media Nos. 2 to 5 of the present invention and comparative recording medium No. 1, the same image formation and erasure test and light resistance test as those in Example 1 were conducted. The results are shown in Table 1.

TABLE 1

| | | Image Formation and Erasure Test | | After Light Resistance Test | | |
|---|---|---|---|---|---|---|
| | Guanidine Derivatives | I.D. (*) in color development state (A) | I.D. in decolorization state (B) | I.D. in color development state (C) | I.D. in decolorization state (D) | (B)-(D) |
| Ex. 1 | 1,3-dicyclohexyl-2-(2,5-dichlorophenyl) guanidine | 1.53 | 0.15 | 1.29 | 0.20 | 0.05 |
| Ex. 2 | 1,3-dicyclohexyl-2-(2,4-dimethylphenyl) guanidine | 1.26 | 0.15 | 1.09 | 0.19 | 0.04 |
| Ex. 3 | 1,3-dicyclohexyl-2-phenylguanidine | 1.19 | 0.15 | 1.05 | 0.19 | 0.04 |
| Ex. 4 | 1,3-diphenylguanidine | 1.38 | 0.16 | 1.12 | 0.25 | 0.09 |
| Ex. 5 | 1,2,3-triphenylguanidine | 1.57 | 0.16 | 1.25 | 0.26 | 0.10 |
| Comp. Ex. 1 | Nil | 1.67 | 0.17 | 1.37 | 0.35 | 0.18 |

(*) I.D.: Image density

EXAMPLE 6

The procedure for the preparation of the reversible thermosensitive recording medium No. 1 according to the present invention in Example 1 was repeated except that the thermosensitive recording layer coating liquid used in Example 1 was replaced by a thermosensitive recording layer coating liquid with the following formulation:

| | Parts by Weight |
|---|---|
| 2-anilino-3-methyl-6-dibutylamino-fluoran | 4 |
| Octadecyl phosphonic acid | 12 |
| Vinyl chloride - vinyl acetate copolymer (Trademark "VYHH" made by Union Carbide Japan K.K.) | 10 |
| Methyl ethyl ketone | 45 |
| Toluene | 45 |
| 1,3-dicyclohexyl-2-(2,5-dichlorophenyl)guanidine | 0.04 |

Thus, a reversible thermosensitive recording medium No. 6 according to the present invention was obtained.

EXAMPLES 7 TO 12 AND COMPARATIVE EXAMPLE 2

The procedure for the preparation of the reversible thermosensitive recording medium No. 6 according to the present invention in Example 6 was repeated except that the amount of 1,3-dicyclohexyl-2-(2,5-dichlorophenyl)guanidine used in the recording layer coating liquid in Example 6 was changed as shown in Table 2.

Thus, reversible thermosensitive recording media Nos. 7 to 12 according to the present invention and a comparative reversible thermosensitive recording medium No. 2 were obtained.

Using each of the above prepared recording media Nos. 6 to 12 of the present invention and comparative recording medium No. 2, the same image formation and erasure test and light resistance test as those in Example 1 were conducted. The results are shown in Table 2.

TABLE 2

| | Amount of Guanidine Derivative (parts by weight) | Ratio by weight of Guanidine Derivative to Coloring Agent | Image Formation and Erasure Test | | After Light Resistance Test | | |
|---|---|---|---|---|---|---|---|
| | | | I.D. in color development state (A) | I.D. in decolorization state (B) | I.D. in color development state (C) | I.D. in decolorization state (D) | (B)-(D) |
| Ex. 6 | 0.04 | 1.0 | 1.68 | 0.15 | 1.37 | 0.31 | 0.16 |
| Ex. 7 | 0.2 | 5.0 | 1.57 | 0.14 | 1.20 | 0.22 | 0.08 |
| Ex. 8 | 0.4 | 10 | 1.68 | 0.15 | 1.48 | 0.21 | 0.06 |
| Ex. 9 | 0.8 | 20 | 1.77 | 0.15 | 1.52 | 0.17 | 0.02 |
| Ex. 10 | 2 | 50 | 1.62 | 0.14 | 1.30 | 0.15 | 0.01 |
| Ex. 11 | 3.2 | 80 | 1.54 | 0.13 | 1.15 | 0.14 | 0.01 |
| Ex. 12 | 6 | 150 | 1.49 | 0.13 | 0.96 | 1.14 | 0.01 |
| Comp. Ex. 2 | 0 | 0 | 1.77 | 0.20 | 1.40 | 0.46 | 0.26 |

EXAMPLE 13

The procedure for the preparation of the reversible thermosensitive recording medium No. 1 according to the present invention in Example 1 was repeated except that the thermosensitive recording layer coating liquid used in Example 1 was replaced by a thermosensitive recording layer coating liquid with the following formulation:

| | Parts by Weight |
|---|---|
| 2-(o-chloroanilino)-6-dibutylamino-fluoran | 4 |
| Octadecyl phosphonic acid | 12 |
| Vinyl chloride - vinyl acetate copolymer (Trademark "VYHH" made by Union Carbide Japan K.K.) | 10 |
| Methyl ethyl ketone | 45 |
| Toluene | 45 |
| 1,3-dicyclohexyl-2-(2,5-dichlorophenyl)guanidine | 0.2 |
| Ethyl-2-cyano-3,3-diphenyl-acrylate (antioxidant: ultraviolet absorber) | 0.2 |

Thus, a reversible thermosensitive recording medium No. 13 according to the present invention was obtained.

EXAMPLES 14 TO 17

The procedure for the preparation of the reversible thermosensitive recording medium No. 13 according to the present invention in Example 13 was repeated except that ethyl-2-cyano-3,3-diphenylacrylate serving as an antioxidant used in the recording layer coating liquid in Example 13 was replaced by the respective antioxidants as shown in Table 3.

Thus, reversible thermosensitive recording media Nos. 14 to 17 according to the present invention were obtained.

EXAMPLE 18

The procedure for the preparation of the reversible thermosensitive recording medium No. 13 according to the present invention in Example 13 was repeated except that the thermosensitive recording layer coating liquid used in Example 13 was replaced by a thermosensitive recording layer coating liquid with the following formulation:

| | Parts by Weight |
|---|---|
| 2-(o-chloroanilino)-6-dibutylamino-fluoran | 4 |
| Octadecyl phosphonic acid | 12 |
| Vinyl chloride - vinyl acetate copolymer (Trademark "VYHH" made by Union Carbide Japan K.K.) | 10 |
| Methyl ethyl ketone | 45 |
| Toluene | 45 |
| 1,3-dicyclohexyl-2-(2,5-dichlorophenyl)guanidine | 0.2 |
| Distearyl thiodipropionate (antioxidant: peroxide decomposer) | 0.1 |
| 4-benzoyloxy-2,2,6,6-tetramethyl-piperidine (antioxidant: light stabilizer) | 0.1 |

Thus, a reversible thermosensitive recording medium No. 18 according to the present invention was obtained.

EXAMPLE 19

The procedure for the preparation of the reversible thermosensitive recording medium No. 13 according to the present invention in Example 13 was repeated except that the thermosensitive recording layer coating liquid used in Example 13 was replaced by a thermosensitive recording layer coating liquid with the following formulation:

| | Parts by Weight |
|---|---|
| 2-(o-chloroanilino)-6-dibutylamino-fluoran | 4 |
| Octadecyl phosphonic acid | 12 |
| Vinyl chloride - vinyl acetate copolymer (Trademark "VYHH" made by Union Carbide Japan K.K.) | 10 |
| Methyl ethyl ketone | 45 |
| Toluene | 45 |
| 1,3-dicyclohexyl-2-(2,5-dichlorophenyl)guanidine | 0.4 |

Thus, a reversible thermosensitive recording medium No. 19 according to the present invention was obtained.

COMPARATIVE EXAMPLE 3

The procedure for the preparation of the reversible thermosensitive recording medium No. 13 according to the present invention in Example 13 was repeated except that the thermosensitive recording layer coating liquid used in Example 13 was replaced by a thermosensitive recording layer coating liquid with the following formulation:

| | Parts by Weight |
|---|---|
| 2-(o-chloroanilino)-6-dibutylamino-fluoran | 4 |
| Octadecyl phosphonic acid | 12 |
| Vinyl chloride - vinyl acetate copolymer (Trademark "VYHH" made by Union Carbide Japan K.K.) | 10 |
| Methyl ethyl ketone | 45 |
| Toluene | 45 |
| Distearyl thiodipropionate (antioxidant: peroxide decomposer) | 0.4 |

Thus, a comparative reversible thermosensitive recording medium No. 3 was obtained.

Using each of the above prepared recording media Nos. 13 to 19 of the present invention and comparative recording medium No. 3, the same image formation and erasure test and light resistance test as those in Example 1 were conducted. The results are shown in Table 3.

TABLE 3

| | Antioxidant | Image Formation and Erasure Test | | After Light Resistance Test | | |
|---|---|---|---|---|---|---|
| | | I.D. in color development state (A) | I.D. in decolorization state (B) | I.D. in. color development state (C) | I.D. in decolorization state (D) | (B)-(D) |
| Ex. 13 | Ethyl-2-cyano-3,3-diphenylacrylate (ultraviolet absorber) | 1.49 | 0.15 | 0.88 | 0.22 | 0.07 |
| Ex. 14 | 2-(2-hydroxy-5-methylphenyl)benzotriazole (ultraviolet absorber) | 1.56 | 0.16 | 1.21 | 0.24 | 0.08 |
| Ex. 15 | 4-benzoyloxy-2,2,6,6-tetramethylpiperidine (light stabilizer) | 1.64 | 0.17 | 1.45 | 0.25 | 0.08 |
| Ex. 16 | Distearyl thiodipropionate (peroxide decomposer) | 1.89 | 0.16 | 1.47 | 0.24 | 0.08 |
| Ex. 17 | 4-methyl-2-mercaptobenzimidazole (peroxide decomposer) | 1.69 | 0.18 | 1.34 | 0.25 | 0.07 |
| Ex. 18 | - Distearyl thiodipropionate (peroxide decomposer) - 4-benzoyloxy-2,2,6,6-tetramethylpiperidine (light stabilizer) | 1.68 | 0.16 | 1.63 | 0.20 | 0.04 |
| Ex. 19 | Nil | 1.58 | 0.14 | 1.22 | 0.24 | 0.10 |
| Comp. Ex. 3 | Distearyl thiodipropionate (peroxide decomposer) | 1.62 | 0.15 | 1.35 | 0.29 | 0.14 |

As previously explained, since the reversible thermosensitive coloring composition according to the present invention comprises a guanidine derivative, the decolorization characteristics are excellent. Specifically, even though the colored image formed in the coloring composition is exposed to light, it can be erased therefrom with the remaining colored portion extremely reduced.

Furthermore, the light resistance of the reversible thermosensitive recording medium according to the present invention is further improved when an antioxidant is used in combination with the guanidine derivative.

What is claimed is:

1. A reversible thermosensitive coloring composition comprising:

i) an electron donor coloring compound serving as a coloring agent;

ii) an electron acceptor compound serving as a color developer capable of inducing color formation in said electron donor coloring compound; and iii) guanidine or a guanidine derivative, represented by formula (I) or (II);

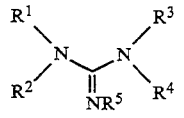

(I)

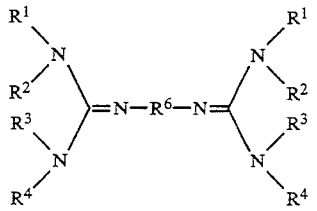

(II)

wherein $R^1$, $R^2$, $R^3$, $R^4$, and $R^5$ in formulas (I) and (II) each is hydrogen, an alkyl group, a cyclic alkyl group, an acyl group, an acylamino group, an aryl group or a substituted aryl group substituted with a member selected from the group consisting of a lower alkyl group, an alkoxy group, nitro group, amino group, an alkylamino group, an acylamino group a halogen atom; and $R^6$ in formula (II) is a lower alkylene group, phenylene group, naphthalene group or a bivalent substituent of the formula (III);

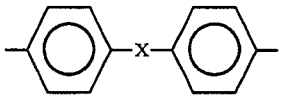

(III)

in which X is a lower alkylene group, $—SO_2—$, —S—S—, —S—, —O—, —NH— or a single bond connecting the two phenyl groups wherein said coloring composition is capable of:

(a) assuming a color development state when said coloring composition is heated to a color development temperature at which said coloring composition is fused;

(b) maintaining said color development state even when said coloring composition is rapidly cooled to room temperature;

(c) assuming a decolorization state when said coloring composition is heated to a decolorization temperature which is lower than said color development temperature; and (d) maintaining said decolorization state at room temperature.

2. The reversible thermosensitive coloring composition as claimed in claim 1, wherein the ratio by weight of said guanidine or guanidine derivative to said coloring agent is in the range from 0.5:100 to 100:100.

3. The reversible thermosensitive coloring composition as claimed in claim 1, further comprising an antioxidant.

4. The reversible thermosensitive coloring composition as claimed in claim 3, wherein said antioxidant is at least one selected from the group consisting of an ultraviolet absorber, a light stabilizer and a peroxide decomposer.

5. The reversible thermosensitive coloring composition as claimed in claim 3, wherein the ratio by weight of said antioxidant to said coloring agent is in the range from 0.5:100 to 100:100.

6. A reversible thermosensitive recording medium comprising a support and a recording layer formed thereon which comprises i) an electron donor coloring compound serving as a coloring agent;

ii) an electron acceptor compound serving as a color developer capable of inducing color formation in said electron donor coloring compound; and iii) guanidine or a guanidine derivative represented by formula (I) or (II);

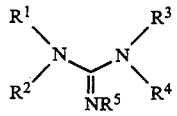

(I)

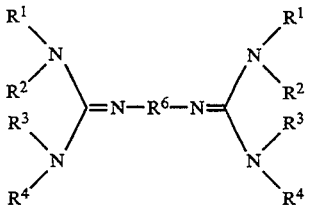

(II)

wherein $R^1$, $R^2$, $R^3$, $R^4$, and $R^5$ in formulas (I) and (II) each is hydrogen, an alkyl group, a cyclic alkyl group, an acyl group, an acylamino group, an aryl group or a substituted aryl group substituted with a member selected from the group consisting of a lower alkyl group, an alkoxy group, nitro group, amino group, an alkylamino group, an acylamino group a halogen atom; and $R^6$ in formula (II) is a lower alkylene group, phenylene group, naphthalene group or a bivalent substituent of the formula (III);

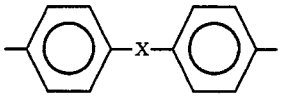

(III)

in which X is a lower alkylene group, $—SO_2—$, —S—S—, —S—, —O—, —NH— or a single bond connecting the two phenyl groups wherein said coloring composition is capable of:

(a) assuming a color development state when said coloring composition is heated to a color development temperature at which said coloring composition is fused;

(b) maintaining said color development state even when said coloring composition is rapidly cooled to room temperature;

(c) assuming a decolorization state when said coloring composition is heated to a decolorization temperature which is lower than said color development temperature; and (d) maintaining said decolorization state at room temperature.

7. The reversible thermosensitive recording medium as claimed in claim 6, wherein the ratio by weight of said guanidine or guanidine derivative to said coloring agent in said reversible thermosensitive coloring composition is in the range from 0.5:100 to 100:100.

8. The reversible thermosensitive recording medium as claimed in claim 6, wherein said reversible thermosensitive coloring composition further comprises an antioxidant.

9. The reversible thermosensitive recording medium as claimed in claim 6, wherein said antioxidant is at least one selected from the group consisting of an ultraviolet absorber, a light stabilizer and a peroxide decomposer.

10. The reversible thermosensitive recording medium as claimed in claim 8, wherein the ratio by weight of said antioxidant to said coloring agent in said reversible thermosensitive coloring composition is in the range from 0.5:100 to 100:100.

* * * * *

UNITED STATES PATENT AND TRADEMARK OFFICE

CERTIFICATE OF CORRECTION

PATENT NO. : 5,403,810

DATED : April 4, 1995

INVENTOR(S) : Ichiro SAWAMURA, et al.

It is certified that error appears in the above-identified patent and that said Letters Patent is hereby corrected as shown below:

Column 4, line 64, "the." should read --the--.

Column 19, line 9, please insert --or-- after "group";

line 42, please delete "or guanidine".

Signed and Sealed this

Twenty-third Day of July, 1996

*Attest:*

*Attesting Officer*

BRUCE LEHMAN

*Commissioner of Patents and Trademarks*